United States Patent [19]

Buck

[11] Patent Number: 4,856,251

[45] Date of Patent: Aug. 15, 1989

[54] SELF-GAUGING, ANTI-ICE DAMMING, DOUBLE SEALED SHINGLE SYSTEM

[76] Inventor: Donald A. Buck, 137 W. Arthur, Roselle, Ill. 60172

[21] Appl. No.: 67,422

[22] Filed: Jun. 25, 1987

Related U.S. Application Data

[63] Continuation-in-part of Ser. No. 17,772, Feb. 20, 1987, abandoned.

[51] Int. Cl.[4] ..... E04D 1/00

[52] U.S. Cl. ..... 52/553; 52/540; 52/555

[58] Field of Search ..... 52/528, 540, 518, 541, 52/551, 552, 555, 553, 542, 543, 94, 420

[56] References Cited

U.S. PATENT DOCUMENTS

| | | | |
|---|---|---|---|
| 1,438,780 | 12/1922 | O'Neil | 52/540 |
| 1,702,609 | 2/1929 | Lesher | 52/518 |
| 1,795,913 | 3/1931 | Weaver | 52/420 |
| 1,966,438 | 7/1934 | Coolidge | 52/518 |
| 2,148,167 | 2/1939 | Lyman | 52/540 |
| 2,226,239 | 12/1940 | Elmendorf | 52/518 |
| 3,111,787 | 11/1963 | Chamberlain | 52/540 |
| 3,262,239 | 7/1966 | Mills | 52/540 |
| 3,468,092 | 9/1969 | Chalmers | 52/543 |
| 3,484,267 | 12/1969 | Sadler | 52/518 |
| 3,511,008 | 5/1970 | Grems et al. | 52/520 |
| 3,771,271 | 11/1973 | Keel | 52/540 |
| 3,848,384 | 11/1974 | Eaton | 52/540 |
| 3,903,340 | 9/1975 | Shepherd | 52/518 |
| 4,078,349 | 3/1978 | Gantner | 52/540 |
| 4,102,107 | 7/1978 | Barker et al. | 52/553 |
| 4,301,633 | 11/1981 | Neumann | 52/540 |
| 4,397,129 | 8/1983 | Kough et al. | 52/528 |
| 4,404,783 | 9/1983 | Freiborg | 52/518 |

FOREIGN PATENT DOCUMENTS

| | | | |
|---|---|---|---|
| 900136 | 5/1972 | Canada | 52/543 |
| 963626 | 3/1975 | Canada | 52/553 |
| 719013 | 11/1931 | France | 52/541 |
| 8102437 | 9/1981 | World Int. Prop. O. | 52/518 |

*Primary Examiner*—Michael Safavi

*Attorney, Agent, or Firm*—Laff, Whitesel, Conte & Saret

[57] ABSTRACT

An improved roofing shingle assembly and system wherein each shingle assembly in the system comprises a shingle having a front edge and a rear edge, a gauge piece bonded to the shingle adjacent the rear edge of the shingle and extending partially across the width of the shingle, the gauge piece including a leading edge adapted to form an abutment surface, and adhesive seal tabs disposed across the length of the shingle on the same side or on the side opposite the gauge piece. The shingle system is completed by abutting the rear of a first shingle assembly against the abutment surface of a second shingle assembly, whereby the adhesive seal tabs hold the first and second shingle assemblies together.

6 Claims, 2 Drawing Sheets

SELF-GAUGING, ANTI-ICE DAMMING, DOUBLE SEALED SHINGLE SYSTEM

This application is a continuation-in-part, of application Ser. No. 017,772, filed 2/20/87, abandoned.

FIELD OF THE INVENTION

This invention relates to a unique roof shingle system and assembly. More particularly, this invention relates to a roof shingle assembly that provides for each installation, prevents normal destructive cupping, and protects roofing systems from adverse weather conditions by means of a self-gauging, anti-ice damming, and double sealing shingle structure.

BACKGROUND OF THE INVENTION

A variety of roof shingles are known, which are used, for example, for leakage protection and at the same time for ornamental appearance. For example, U.S. Pat. No. 2,058,578 discloses a thick butt shingle of the felt-based type that is self-spacing and interlocking and is designed to prevent the exposed portion of the shingle from flapping in the wind by aligning non-homologous edges of the shingles with each other. These non-homologous shingle edges comprise a rectangular projection on one edge of the shingle and a recess or indentation on the opposite side. The shingles are then placed whereby the projection of shinge abuts the recess of another shingle, with a second coating layer overlaying a first coat of granular material. The second coat merely provides an additional coat of granular material, and does not serve as an aid in alignment or for any other purpose. Thus, while the shingle disclosed in U.S. Pat. No. 2,058,578 helps to resolve the crooked roof problem, it does not address the problems of shingle cupping or preventing ice damming.

Clearly, such prior art shingles are designed to provide roof protection and aesthetic appearance. However, these same shingles do not effectively resolve the cupping, ice damming, or fly away shingle problems.

The present invention, by contrast with the above-described shingle, is concerned primarily with providing a more durable shingle; specifically, one that prevents: (1) the destructive cupping of the exposed portion of the shingle; (2) leakage induced by ice dam formations; and (3) removal of shingles due to inclement weather conditions. The present invention further provides for each of installation and proper shingle alignment which eliminates the possibility of a crooked roof shingle line.

The present invention contemplates a shingle assembly that is self-gauging, anti-ice damming and double sealed.

The self-gauging system inherent in the present invention serves a multitude of purposes. First of all, the present shingle provides for each of installation because of the automatic gauge built into the shingle. The added gauging material, which is equal in thickness to the shingle, will also prohibit the shingle from cupping upon installation. Second, because of the shingle's self-gauging system, the shingle will be easier to install in a straight line, and thus eliminate the possibility of a crooked roof shingle line. Hence, the shingle will lay flatter on the roof.

The present invention includes a double sealed shingle structure which eliminates ice damming. Ice damming occurs when ice forms on shingles and then travels beneath the shingles and causes leakage due to the inherent expansion of ice. The present invention provides two seal tabs per shingle. In the preferred embodiment, there seal tabs are located at the rear and at the center of the top side of the shingle. In an alternate preferred embodiment, these seal tabs are located at the front and at the center of the back side of the shingle. The extra seal tab, coupled with the double thickness of the shingle (equal thickness in the shingle and gauge piece), prevents the formation of ice beneath the shingles. Furthermore, the extra seal tab prohibits the removal of shingles due to high winds because of added adhesive strength and the added stability provided through the shingle's double thickness.

SUMMARY OF THE INVENTION

Accordingly, it is an object of the present invention to provide a roof shingle assembly with an automatic gauge that prohibits the shingle from cupping upon installation.

It is another object of the present invention to provide a shingle assembly that eliminates the possibility of a crooked roof through use of a self-gauging system.

It is a further object of the present invention to provide a shingle assembly with an additional seal tab at the rear of the front side of the shingle or the center of the back side of the shingle, coupled with the double thickness of the shingle, for the prevention of ice formation beneath the shingle.

It is also an object of the present invention to provide a shingle assembly that enhances its stability through an extra seal tab and thus, prohibits the removal of shingles during inclement weather conditions.

Furthermore, it is an object of the present invention to provide ease of installation and simplicity of manufacture of a shingle system having the above-mentioned attributes.

The invention seeks to achieve the foregoing and other advantages which will become apparent from the following description of the preferred embodiment of the shingle comprising: (i) a single ply shingle impregnated with water-proofing material, (ii) a gauge piece with water-proofing material underlying and bonded to a portion of the shingle and completely covering less than one half of the underside of the shingle; (iii) the shingle structure including two seal tabs located at the rear and in the center of the front side of the shingle or at the front and at the center of the back side of the shingle; (iv) the gauge piece adapted to abut the length and rear of a second shingle and thereby serve the above enumerated functions.

Further objects will appear from a consideration of the following description of the invention.

DETAILED DESCRIPTION OF THE INVENTION

Figure 1:
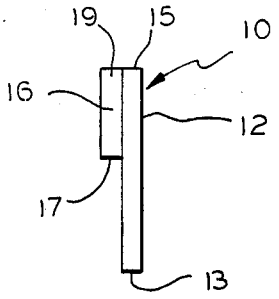
FIG. 1 is a side elevation view of the improved shingle.

The present invention contemplates a self-gauging, anti-ice damming, double sealing roof shingle assembly designated by the numeral 10 in FIGS. 1–4, which shingle allows for accurate and easy installation and prevents cupping, and fly away shingles. A preferred embodiment of the invention will now be described by way of example only.

A single ply shingle 12 having a front edge 13 and a rear edge 15 is impregnated with water-proofing material or is initially made from a water-proof material such as asphalt or fiberglass. The shingle 12 is of comparable thickness to other shingles on the market and has similar vertical indentations or cut-away portions 14 for drainage, as shown in FIG. 2.

Figure 4:
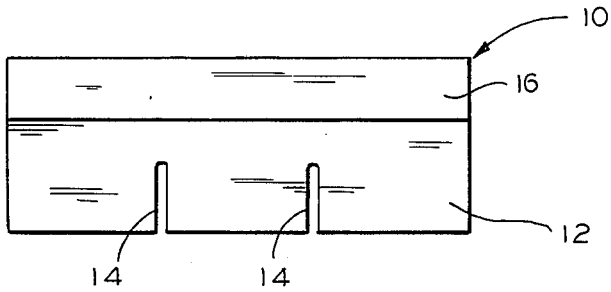
FIG. 4 is a plan view of the underside of one forms of the improved shingle.

A gauge piece 16 is bonded to the underside of the shingle 12, as shown in FIG. 1 and 4. The gauge piece 16 covers the underside of approximately less than one half of the shingle, and may range in width from about one inch to about five inches in the preferred embodiment. The gauge piece 16 is the same thickness as the shingle 12. The gauge piece 16 as a front edge 17 and a rear edge 19.

Affixation of the gauge piece 16 to shingle 12 is accomplished by a variety of bonding means, for example, asphalt glue, cement, or the like. The bonded gauge piece 16 and shingle 12 results in a partial two-ply shingle assembly 10 bonded together over less than one half of the shingle, as shown by FIG. 1. The partial two-ply shingle assembly 10 results in a shingle that has, in part, twice the standard shingle thickness.

Figure 2:
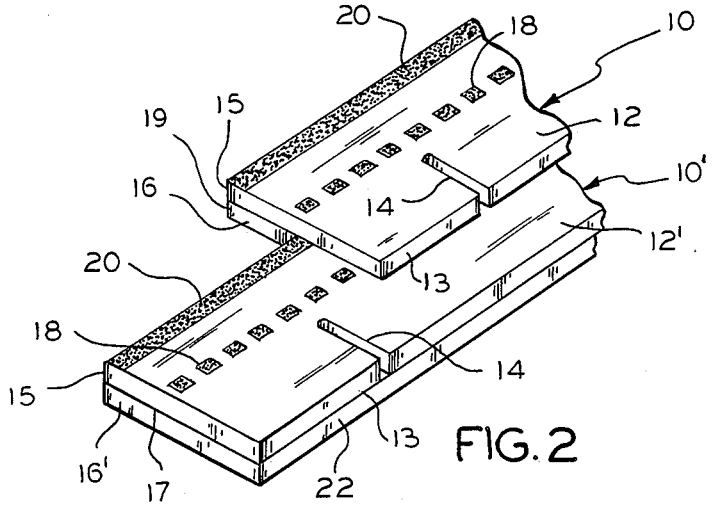
FIG. 2 is a perspective view of one preferred embodiment of the shingle assembly.
Figure 3:
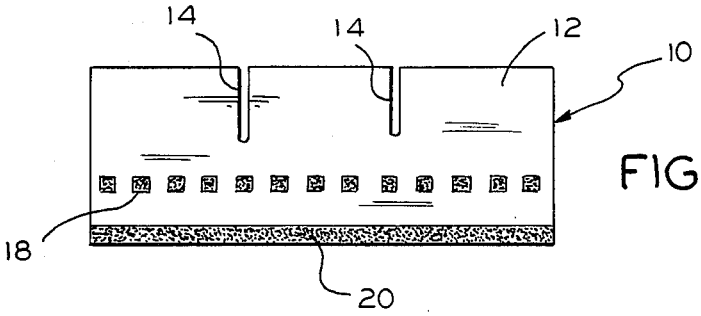
FIG. 3 is a plan view of one form of the improved shingle.

FIGS. 2 and 3 illustrate that the top side of the shingle assembly 10 is provided with a standard adhesive seal tab 18 plus a solid strip adhesive seal tab 20. The solid strip adhesive seal tab 20 is located on the rear edge 15 of the shingle 12 and runs along the entire length of the shingle 12. The standard seal tab 18 extends horizontally across the shingle 12 length-wise and is positioned at or near the center of the shingle assembly 10 between the seal strip 20 and the front edge 13. The size of both strips is determined by the amount of exposure of the shingle assembly 10 to the weather. A paper or foil back will be applied to the back of the double shingle area during packaging and shipping so that the seal strips will not adhere to other shingles during shipment.

Figure 5:
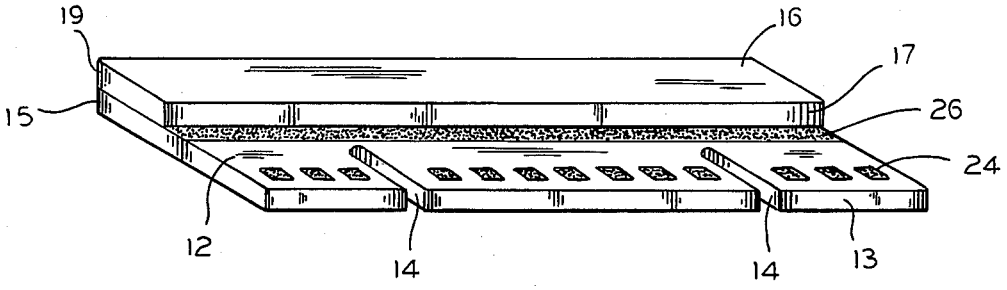
FIG. 5 is a perspective view of an alternate preferred embodiment of the underside of the improved shingle.
Figure 6:
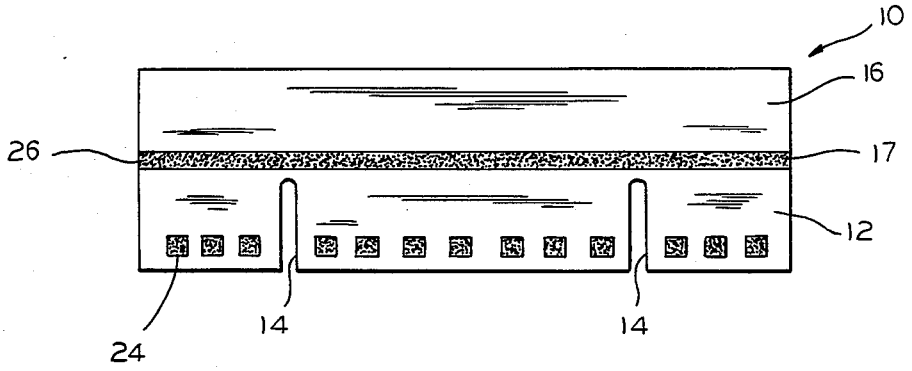
FIG. 6 is a plan view of an alternate preferred embodiment of the underside of the improved shingle.

In an alternate preferred embodiment, FIGS. 5 and 6 illustrate that the bottom side of the shingle assembly 10 is provided with a standard adhesive seal tab 24 plus a solid strip adhesive seal tab 26. The sold strip adhesive seal tab 26 is positioned approximately centrally on the backside of shingle 12 at the juncture of the gauge piece 16 and the shingle 12. The solid strip adhesive seal tab 26 runs along the entire length of the shingle 12. The standard seal tab 24 extends horizontally across the backside of shingle 12 length-wise and is positioned along the front edge of shingle 12. The size of both strips is determined by the amount of exposure of the shingle assembly 10 to the weather. A paper or foil back will be applied to the back of the double shingle area during packaging and shipping so that the seal strips will not adhere to other shingles during shipment.

When installed in the preferred embodiment of the shingle system, the shingle assemblies 10, 10′ are overlapped as shown in FIG. 2, whereby the forward edge of the gauge piece 16 of shingle assembly 10 abuts the rear edge of the overlapped shingle assembly 10′. The front portion of the shingle 12 attached to the gauge piece 16 of assembly 10 rests across the solid strip seal tab 20 and the standard seal tab 18 of the overlapped shingle assembly 10′. The adhesive strip seal tabs 18, 20 cause shingle assembly 10 to adhere to shingle assembly 10′.

The shingle assemblies 10, 10′ are accordingly overlapped. The shingle assemblies are properly located on the roof edge and the initial shingle assembly is bonded to a starter strip 22. Starter strip 22 extends from the front of initial shingle assembly 10′ (FIG. 2) to the lead edge of gauge piece 16′ to provide a support for the initial shingle assembly. The inside edge of starter strip 22 abuts the inner edge of the gauge piece 16′. Starter strip 22 provides for complete uniformity in shingle thickness, even for the shingles positioned on the roof's edge. Thus, the shingle assemblies 10 have twice the standard thickness of prior art shingles throughout the entire roofing surface.

In an alternate preferred embodiment of the shingle system illustrated in FIGS. 5 and 6, the shingle assemblies 10, 10′ are similarly overlapped as shown in FIG. 2, whereby the forward edge of the gauge piece 16 of shingle assembly 10 abuts the rear edge of the overlapped shingle assembly 10′. The front portion of the shingle 12, attached to the gauge piece 16 of the assembly 10, houses the solid strip seal tab 26 and the standard seal tab 24 and rests across the overlapped shingle assembly 10′. The adhesive strip seal tabs 24, 26 causes shingle assembly 10 to adhere to shingle assembly 10′.

The shingle assemblies 10, 10′ in the alternate preferred embodiment of FIGS. 5 and 6 are similarily overlapped as the shingle assemblies in the preferred embodiment.

Prior to the present invention, cupping frequently occurred during installation. The prior art shingles were fastened to the roof, for example, with staples. The fastening means of the prior art often caused the shingles to buckle. A buckled shingle permits ice formation beneath the shingle and exposes the underside of the shingle to high winds. By contrast, the present invention eliminates shingle buckling by providing for a more stable shingle structure. In the present invention, the shingle 12 is bonded to the gauge piece 16 and is attached to an adjacent shingle assembly by separately located seal tabs 18, 20 in the preferred embodiment and by seal tabs 24, 26 in the alternate preferred embodiment. Thus, the present invention provides for means for fastening the shingle assemblies together that eliminates the need for stapling, etc.

The elimination of shingle cupping also prevents ice-damming and fly-away shingle problems. In the absence of cupping, the shingle rests flatly on the roof and on adjacent shingle assemblies and thus ice and water build up will not form beneath the shingle. Furthermore, without a cupped shingle-lip, the shingle is not susceptible to high winds that cause fly-away shingle problems.

It is will now be appreciated that the present invention provides a significant improvement in shingle assemblies in that a method is provided of shingling a roof that is easy and accurate and prevents ice damming, fly away shingles, and cupping.

The foregoing description is for purposes of illustration rather than limitation of the scope of protection accorded this invention. The latter is to be measured as broadly as the invention permits.

I claim:

1. An improved roofing shingle assembly comprising a shingle having a front edge, a rear edge and cut away portions to permit drainage, a gauge piece being of the same thickness as said shingle and bonded to said shingle adjacent to and aligned with said rear edge of said shingle and extending partially across a width of said shingle, said gauge piece being of uniform thickness and including a leading edge adapted to form an abutment surface, and adhesive seal tab means disposed on and across a length of said shingle on a side opposite said gauge piece, said assembly including a starter strip attached to said shingle on the side of said shingle to which said gauge piece is bonded, said starter strip extending from said abutment surface to the front edge of said shingle.

2. An improved roofing shingle system including at least first and second roofing shingle assemblies, each said roofing shingle assembly comprising a shingle having a front edge, a rear edge and cut-away portions, a gauge piece being of the same thickness as said shingle and extending partially across a width of said shingle, said gauge piece being of uniform thickness and including a leading edge adapted to form an abutment surface, and adhesive seal tab means disposed on and across a length of said shingle on a side opposite said gauge piece, said roofing shingle system being formed by abutting the rear of a first roofing shingle assembly against the abutment surface of the gauge piece of a second roofing shingle assembly, said second roofing shingle assembly being attached to said first roofing shingle assembly by means of said adhesive seal tab means, said first roofing shingle assembly includes a starter strip attached to said shingle on the side of said shingle to which said gauge piece is bonded, said starter strip extending from said abutment surface to the front edge of said shingle.

3. An improved roofing shingle assembly comprising a shingle having a front edge, a rear edge and cutaway portions to permit drainage, a gauge piece being of the same thickness as said shingle and bonded to said shingle adjacent to and aligned with said rear edge of said shingle and extending partially across a width of said shingle, said gauge piece being of uniform thickness and including a leading edge adapted to form an abutment surface, and adhesive seal tab means disposed on and across a length of said shingle on a side with said gauge piece, said shingle assembly including a starter strip attached to said shingle on the side of said shingle to which said gauge piece is bonded, said starter strip extending from said abutment surface to the front edge of said shingle.

4. An improved roofing shingle system including at least first and second roofing shingle assemblies, each said roofing shingle assembly comprising a shingle having a front edge, a rear edge and cut-away portions, a gauge piece being of the same thickness as said shingle and extending partially across a width of said shingle, said gauge piece being of uniform thickness and including a leading edge adapted to form an abutment surface, and adhesive seal tab means disposed on and across a length of said shingle on a side with said gauge piece, said roofing shingle system being formed by abutting the rear of a first roofing shingle assembly against the abutment surface of the gauge piece of a second roofing shingle assembly, said second roofing shingle assembly being attached to said first roofing shingle assembly by means of said adhesive seal tab means, said first roofing shingle assembly includes a starting strip attached to said shingle on the side of said shingle to which said gauge piece is bonded, said starter strip extending from said abutment surface to the front edge of said shingle.

5. An improved roofing shingle system including at least first and second roofing shingle assemblies, each said roofing shingle assembly comprising a shingle having a front edge, a rear edge and cut-away portions, a gauge piece being of the same thickness as said shingle and extending partially across a width of said shingle, said gauge piece being of uniform thickness and including a leading edge adapted to form an abutment surface, and adhesive seal tab means disposed on and across a length of said shingle on a side opposite said gauge piece, said roofing shingle system being formed by abutting the rear of a first roofing shingle assembly against the abutment surface of the gauge piece of a second roofing shingle assembly, said second roofing shingle assembly being attached to said first roofing shingle assembly by means of said adhesive seal tab means, said cut-away portions are vertically positioned on the top of said shingle, said cut-away portions extending from the front edge of said shingle towards the center of said shingle.

6. An improved roofing shingle system including at least first and second roofing shingle assemblies, each said roofing shingle assembly comprising a shingle having a front edge, a rear edge and cut-away portions, a gauge piece being of the same as said shingle and extending partially across a wide of said shingle, said gauge piece being of uniform thickness and including a leading edge adapted to form an abutment surface, and adhesive seal tab means disposed on and across a length of said shingle on a side with said gauge piece, said roofing shingle system being formed by abutting the rear of a first roofing shingle assembly against the abutment surface of the gauge piece of a second roofing shingle assembly, said second roofing shingle assembly being attached to said first roofing shingle assembly by means of said adhesive seal tab means, said cut-away portions are vertically positioned on the top of said shingle, said cut-away portions extending from the front end of said shingle towards the center of said shingle.

* * * * *